US005590788A

United States Patent [19]

Inman

[11] Patent Number: 5,590,788

[45] Date of Patent: Jan. 7, 1997

[54] HOODED TRAY

[75] Inventor: Michael A. Inman, Bristol, United Kingdom

[73] Assignee: Assi Packaging Systems Unlimited, Bristol, United Kingdom

[21] Appl. No.: 628,815

[22] Filed: Apr. 5, 1996

Related U.S. Application Data

[63] Continuation of Ser. No. 204,170, filed as PCT/GB92/0611; Sep. 3, 1992 published as WO93/04932; Mar. 18, 1993, abandoned.

[30] Foreign Application Priority Data

Sep. 3, 1991 [GB] United Kingdom ..... 9118805

[51] Int. Cl.[6] ..... B65D 5/20

[52] U.S. Cl. ..... 206/736; 229/23 BT

[58] Field of Search ..... 206/736, 738, 206/745, 751, 756, 524.9; 229/186, 187, 190, 23 BT

[56] References Cited

U.S. PATENT DOCUMENTS

| | | | |
|---|---|---|---|
| 3,955,671 | 5/1976 | Ockey | 206/44 R |
| 4,113,100 | 9/1978 | Soja et al. | 206/44 R |
| 5,325,978 | 7/1994 | Rabig | 206/45.11 X |

FOREIGN PATENT DOCUMENTS

| | | |
|---|---|---|
| 1190156 | 3/1959 | France . |
| 2063582 | 7/1971 | France . |
| 2206563 | 1/1989 | United Kingdom . |

*Primary Examiner*—Jacob K. Ackun
*Attorney, Agent, or Firm*—Loeb & Loeb LLP

[57] ABSTRACT

A hooded tray and a blank for manufacturing such a tray. The hooded tray has two open topped trays having opposed product containing and enclosing side and end walls. The two trays are assembled together into a closed transport configuration, with the open top of one tray facing the open top of the other. Each of the trays presents an upstanding wall arranged, when the trays are assembled, to make wall-to-wall contact with a side or end wall of the other tray. This enables the two trays to be easily located relative to each other.

21 Claims, 5 Drawing Sheets

HOODED TRAY

This is a continuation of application Ser. No. 08/204,170, filed as PCT/GB92/01611, Sep. 3, 1992 published as WO93/04932, Mar. 18, 1993, now abandoned.

This invention relates to trays or cartons (hereinafter simply referred to as "trays").

The invention is particularly concerned with trays which are employed both for transporting products to, for example, a sales point and for displaying the products at the sales point for consumer purchase purposes.

Such trays are known as hooded trays and in the transport condition the trays are assembled in closed configuration while in the display condition the tray is either modified by tearing, splitting or cutting off part thereof for example, to provide an open configuration, or part of the tray is discarded to provide the open configuration.

Another known form of hooded tray is one in which there is a display tray wholly enclosed in a separate closed configuration transport tray, which is disadvantageous in that two distant and separate components require to be produced which is costly insofar as tooling and materials are concerned.

Known hooded trays are generally satisfactory for transport purposes, but when they are used for display purposes, they are often unsightly and/or don not readily permit easy access to the contained products, or, alternatively, inadequately contain the products at the sales point.

It is an object of the present invention to provide a hooded tray which obviates or mitigates the aforesaid disadvantages.

According to a first aspect of the present invention there is provided a hooded tray comprising two open-top trays adapted for detachable open-top to open-top assembly into a closed transport configuration, wherein each tray has a main panel supporting first and second opposed end walls and first and second opposed side walls, the end and side walls of each tray are secured together by flaps at corners of the main panels, each side wall of each tray includes opposing upstanding portions adjacent its first end wall, the dimensions of the main panels of the two trays are substantially equal, the widths of the first end walls of the two trays are substantially equal, the heights of the first end walls of the two trays are substantially equal, the widths of the second end walls of the two trays are substantially equal, the height of each first end wall is greater than the height of each second end wall, and the width of each first end wall is greater than the width of each second end wall, whereby when assembled the second end wall of each tray may be readily inserted between the upstanding portions of the side walls of the other tray such that the second end wall of one tray abuts the first end wall of the other tray.

As a result there is provided an easily and readily assembled hooded tray which protectively encloses the contained products during transport and which is easily and readily adapted for display purposes merely by disengaging and discarding the hood tray leaving the products attractively and securely contained in the display tray which can be disposed on a shelf or elsewhere at a sales point.

Preferably the height of at least one upstanding portion of a side wall of each tray is substantially equal to the height of the end walls.

Preferably the heights of each upstanding portion of each side wall of the two trays are substantially equal to each other and to the height of the first end walls.

Preferably the two open-top trays are identical.

Preferably the upstanding portions of each tray are formed by the flaps that secure the side walls of each respective tray to its first end wall.

Preferably the width of the main panel of each tray adjacent the respective first end wall is greater than the width of the main panel of each tray adjacent the respective second end wall, such that in plan view each tray tapers slightly inwardly from its first end wall to its second end wall.

Preferably each tray is formed of board or a board composite, e.g. board with a plastics layers, or any other convenient material.

Preferably each tray is formed from a blank erectable into tray form.

Consequently, each hooded tray is preferably formed from two, preferably identical, blanks.

An advantage of a hooded tray formed from two identical blanks is that only a single tool or tool assembly is required to manufacture the blanks. of the length of the tray. This provides for stacking strength so that packed hooded trays can be safely stacked one on top of another without risk of damage to the contained products.

Preferably the side walls of each tray are recessed or are cut out so that in the assembled hooded tray a window is formed in each side whereby the contained products can be readily viewed and/or inspected.

Preferably each tray is provided with a dividing wall or partition parallel with its side walls and extending for half, or substantially so, of the length of the tray, the dividing walls or partitions in the assembled hooded tray abutting end-to-end to divide the interior thereof into two separate side-by-side areas.

Preferably the dividing walls or partitions are centrally disposed to provide two equal side-by-side areas.

Preferably the hooded tray is produced ready glued so that each end wall is secured to both side walls in a manner that allows the side and end walls to be folded flat.

According to a second aspect of the present invention there is provided a blank for erection to a tray adapted for assembly into a hooded tray, the blank comprising a main panel constituting the top or bottom of a hooded tray, two opposed side wall panels integral with the main panel at opposite sides thereof, an end wall panel integral with one end of the main panel and having opposed lateral securing flaps, an end wall panel integral with the other end of the main panel and having opposed lateral securing flaps, the length of the latter end wall panel and its securing flaps being greater than the length of the former end wall panel and its securing flaps, and the width of the latter end wall panel being greater than the width of the former end wall panel.

Preferably the main panel is tapered inwardly from its end adjacent the latter end wall panel to its end adjacent the former end wall panel.

Preferably the sum of the widths of the main panel and the two side wall panels is the same as the sum of the widths of each end panels and its respective lateral securing flaps.

Alternatively, the sum of the widths of the latter end wall panel and its securing flaps is greater than the sum of the widths of the main wall panel and the two side panels and is greater than the sum of the widths of the former end wall panel and its securing flaps.

Preferably, in the alternative arrangement, the sum of the widths of the main panel and the two side panels is equal to the sum of the widths of the former end panel and its securing flaps are of the same width.

The side wall panels and the securing flaps of the latter end wall panel may be recessed to define window areas in the tray formed by the erected blank.

The side wall panels, for a first part of their lengths, are of greater width than for a second part, the sum of the widths of the first parts of the side wall panels and the main panel is equal to the sum of the widths of the latter end wall panel and its securing flaps, and the latter end wall panel has integral therewith partition flaps adapted, in the assembled blank, to be contiguous, lie inboard of the latter end wall panel, and be parallel with the side wall panels.

Preferably the former end wall panel is recessed to provide a viewing or access area in the tray formed by the assembled blank.

The main panel may have chamfered corners with the side wall panels having end securing flaps and the securing flaps of the latter end wall panel being foldable to provide for chamfered corners in the tray formed by the erected blank.

The main panel may be wider than the former end wall panel and narrower than the latter end wall panel.

The lateral securing flaps of the latter end wall panel may be foldable about fold lines arranged to intersect the adjacent corners of the main panel such that the lateral securing flaps may be folded double between the main panel and the latter end wall panel, and the side wall panels may be foldable about fold lines arranged to intersect respective corners of the main panel adjacent the former end wall panel, cut outs provided to enable the folding flat of the blank after securing the side wall panels to the lateral securing flaps.

The blanks may be machine erected or hand erected.

The display tray and the transport tray of the hooded tray are preferably adapted to be easily and readily discernible one from another. For example, they may be of different colours and/or patterns or may simply be clearly marked "TOP" and "BOTTOM".

They may be temporarily glued or otherwise secured together in the hooded tray condition, the securing connection preferably being readily frangible.

A convenient hole, recess or cut out may be provided in the region of the securing connection for ease of access to break the connection.

There may be more than one frangible securing connection between the trays of a hooded tray.

The side walls of each tray may be of uniform depth or varying depth or of irregular or regular varying depths provided the edges of the trays meet in the hooded tray save where a window is provided.

The board employed is preferably of multi-layered construction with two outer flat plain layers sandwiching a middle corrugated layer.

Embodiments of the present invention will now be described, by way of example, with reference to the accompanying drawings, in which.

Figure 1:
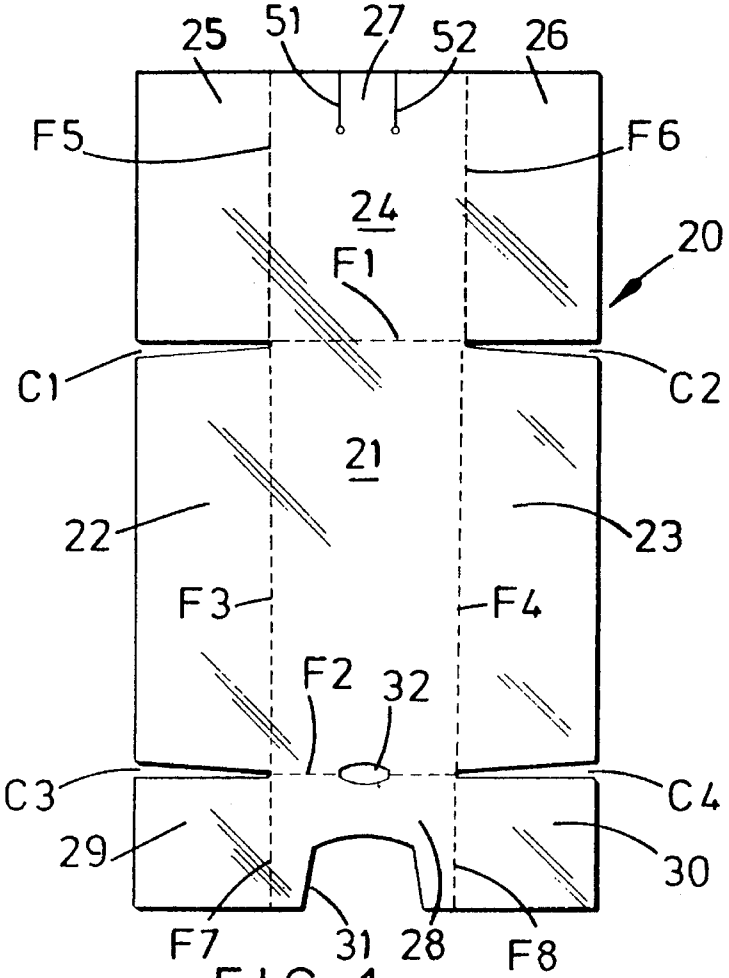

Referring to FIG. 1 of the drawings, the blank 20 comprises a main panel 21 which reduces slightly in width from a fold line F1 at one end to a fold line F2 at its other and opposed end.

A side wall panel 22, 23 is connected to a respective side of the main panel 21 at fold lines F3 and F4 respectively.

A long end wall panel 24 is connected to the main panel 21 at the fold line F1 and side flaps 25 and 26 are secured to respective sides of the end wall panel 24 at fold lines F5 and F6 respectively.

A flap 27 is formed in the center of the end wall panel 24 at its outer edge by slits S1, S2. The purpose of this flap 27 will be described later.

The slide flaps 25, 26, it will be noted, are separated from the corresponding side wall panels 22, 23 by cut-outs C1, C2 respectively.

A short end wall panel 28 is secured to the main panel 21 at fold line F2 and side flaps 29 and 30 are secured to respective sides of the end wall panel 28 at fold lines F7 and F8 respectively.

A recess or cut-out 31 is formed centrally of the end wall panel at its outer edge for a purpose to be described later.

Like the side flaps 25, 26, the side flaps 29, 30 are separated from the side wall panels 22, 23 by cut-outs C3, C4 respectively.

A hand hole 32 is formed centrally of the end wall panel 28 at the fold line F2.

It is to be noted that the overall width of the blank 20 is constant.

The blank 20 is formed of multi-layer board, namely two outer flat plain layers sandwiching an inner corrugated layer.

The aforesaid blank 20 is erected to form a tray 40 (see FIG. 6) by folding side flap panels 22, 23 about fold lines F3, F4 to a vertical disposition; by folding the end wall panel 28 and its side flaps 29, 30 about fold lines F2, F7 and F8 respectively with the side flaps 29, 30 lying inside and alongside side wall panels 22, 23 respectively, the side flaps 29, 30 being glued or otherwise secured to the side wall panels 22, 23; and by similarly folding the end wall panel 24 and its side flaps 25, 26 about fold lines F1, F5 and F6 respectively with the side flaps lying outside and alongside the side wall panels 22, 23 respectively, the side flaps 25, 26 being glued or otherwise secured to the side wall panels.

The erected tray 40 is, in side elevation, of L-configuration and, in plan view tapers slightly inwardly (narrows in width) from end wall panel 24 to end wall panel 28.

The height of the end wall panel 24 and side flaps 25, 26 is twice that of the end wall panel 28 and the side flaps 29, 30.

A tray 40 serves as a display tray and is loaded with product, for example packets or bottles (not shown), and an identical and inverted tray 41 (see FIGS. 6 and 7) serves as a transport tray and co-operates with the tray 40 to form a hooded tray 42 of closed configuration.

The assembly of the trays 40, 41 is facilitated by the end-to-end tapering of each tray to allow the narrower end of each to be slidably spigotted into the wider open socket end defined by the upstanding or longer end wall panel 24 and side flaps 25, 26.

The trays 40, 41 when assembled in hooded tray configuration 42 may be temporarily glued or otherwise secured together under one or both flaps 27, the temporary connection being broken by simply pulling on the flap or flaps 27, the hand hole 32 facilitating gripping the flap 27.

The recess or cut-out 31 in the display tray 40 assists viewing of the product and eases removal especially when the tray 40 is fully packed.

The display tray 40 is preferably a different colour, or is differently patterned, or is otherwise visually distinguished from the transport tray 41 so that top and bottom of the hooded tray 42 are easily discernible.

Figure 6:
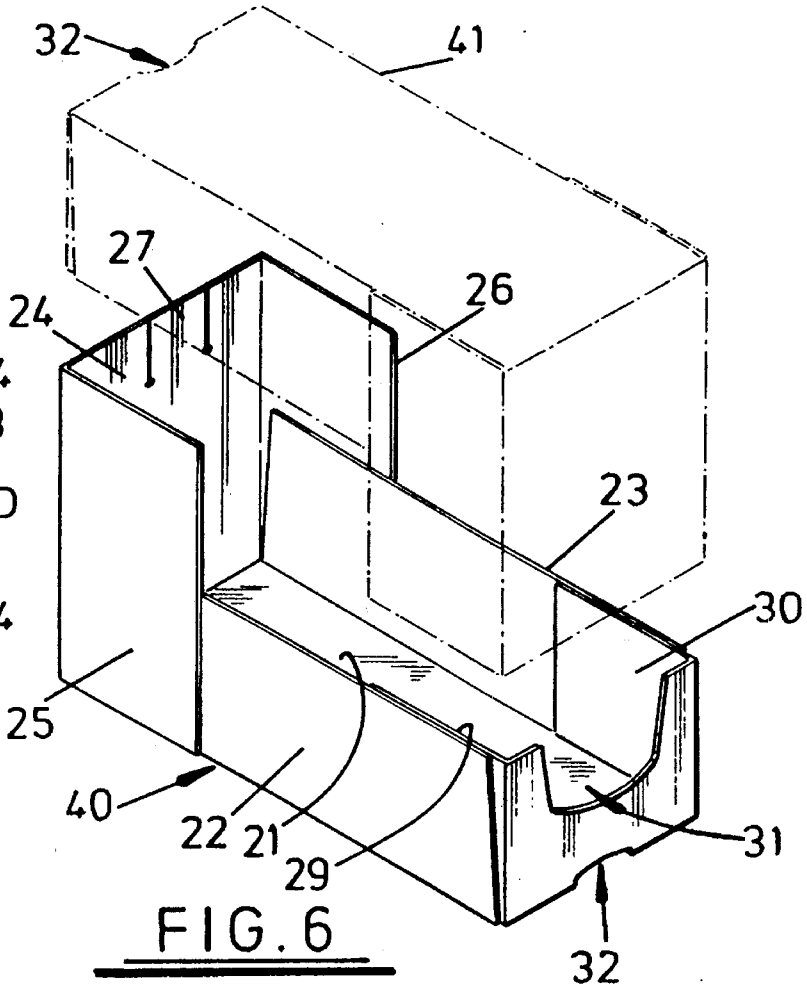
FIG. 6 is an exploded perspective view of a hooded tray formed from FIG. 1 blanks.
Figure 5:
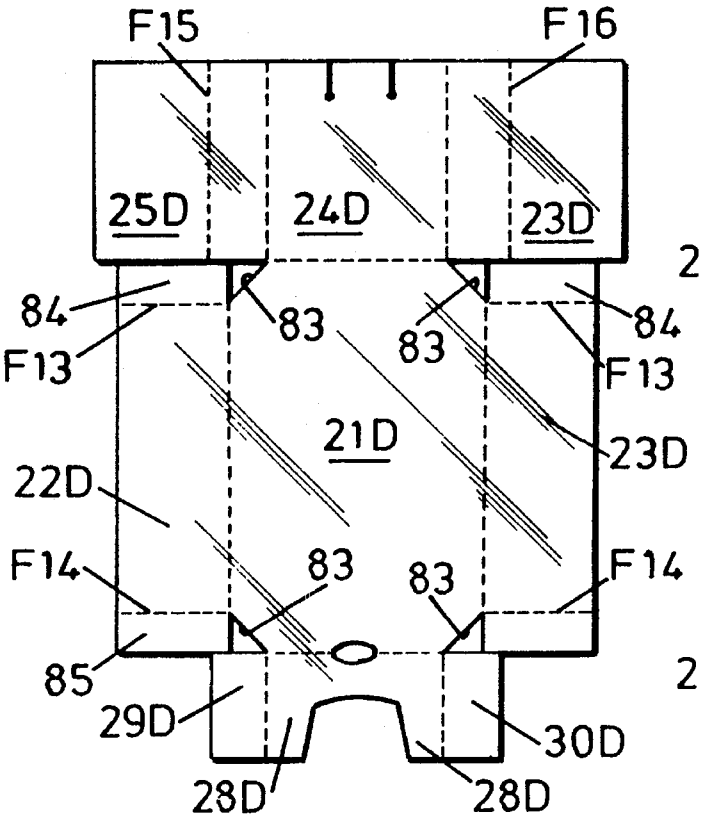
Figure 7:
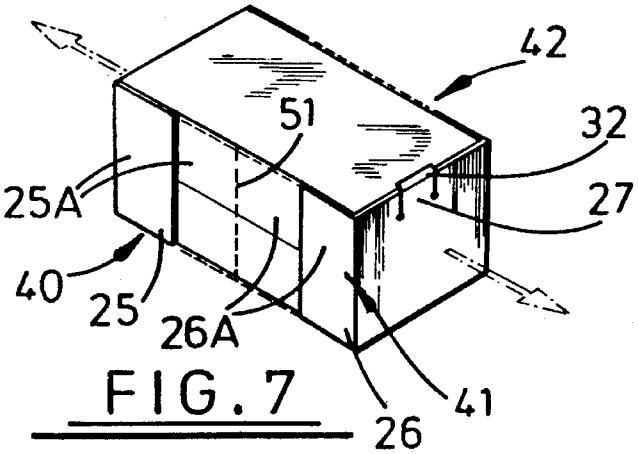
FIG. 7 is a perspective view of a closed hooded tray made from either FIG. 1 or FIG. 2 blanks.

Various modifications may be made and in this connection reference is made to FIGS. 6 and 7.

In one modification, the end wall flaps 25, 26 of one or both trays are of the length shown in FIG. 1 with the end wall panel 24 being the same length as the end wall panel 28 and its side flaps 29, 30.

Thus one or both trays is nested between long side flaps of the other when the trays are assembled to form a hooded tray.

In the display and the transport trays 40, 41 of FIGS. 6 and 7 the top of the side wall panels is parallel with the bottom of the side wall panels. This need not be so. The top edges may be inclined or slanted or may be of regular or irregular interrupted construction (corrugated or jigsaw configuration) provided that in the assembled hooded tray the side walls of the latter are of closed configuration.

In describing the blanks of FIGS. 2 to 5 and the trays erected therefrom, only the differences between them and the blank of FIG. 1 and the trays of FIGS. 6 and 7 will be detailed.

Figure 2:
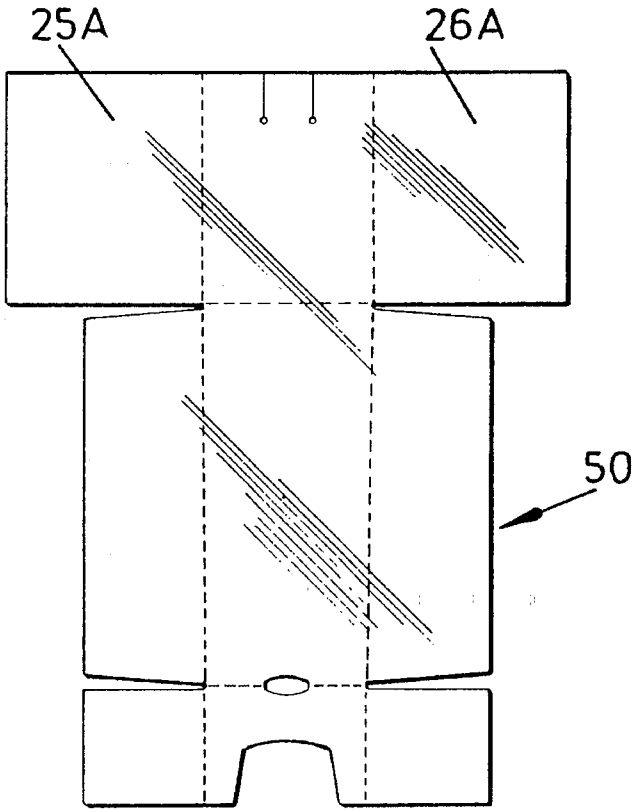
FIGS. 1 to 5 are plan views of different blanks for erecting to form trays according to this invention.

Referring to FIG. 2, the blank 50 differs from that of FIG. 1 in that the side flaps 25A, 26A are wider than side flap 25, 26 so that in the erected tray (see FIG. 7) the vertical edges of the upstanding side walls defined by these flaps 25A, 26A butt together as indicated at 51.

This construction provides hooded trays having increased stacking strength compared with the hooded tray of FIG. 6 where the vertical edges do not abut one another.

Compared with the blank (and erected tray) of FIG. 2 the blank (and erected tray) of FIG. 1 has the advantage that less material (board) is used to wholly enclose the contained product of a hooded tray assembled therefrom.

Figure 3:
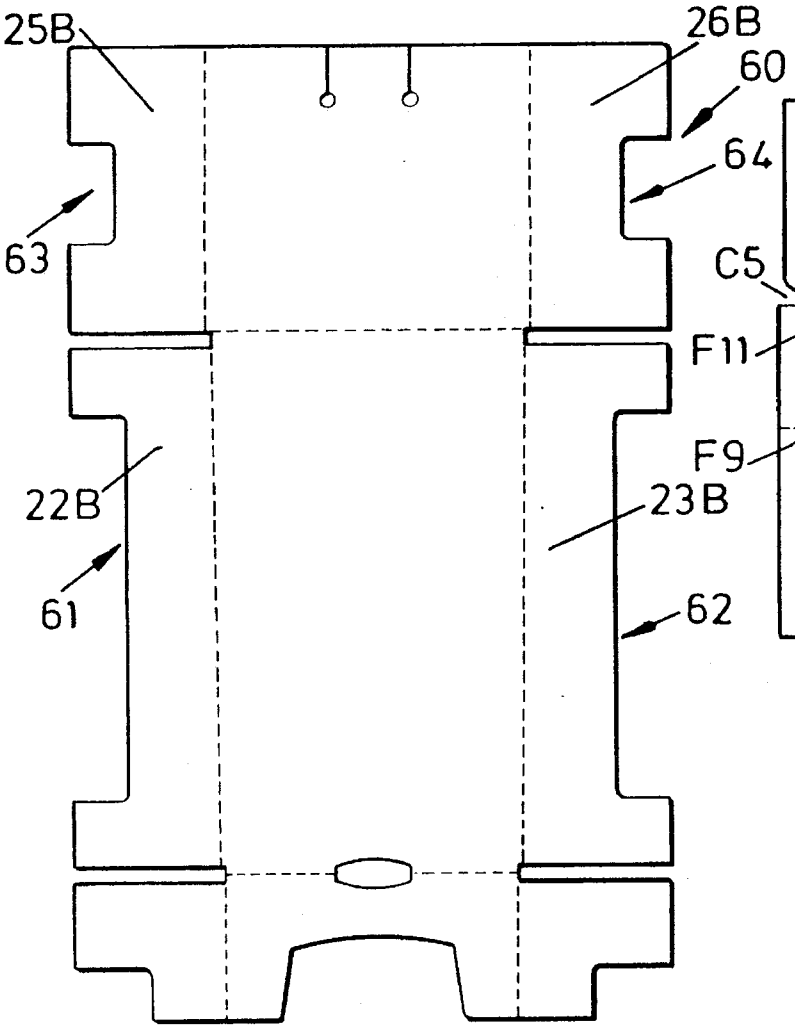

Referring now to FIG. 3, the difference in this blank 60 compared with that of FIG. 1 is that cut-outs or recesses 61, 62 are provided in the long side edges of the side wall panels 22B, 23B. Similarly cut-outs or recesses 63, 64 are provided in the corresponding side edges of the side flaps 25B, 26B.

Figure 8:
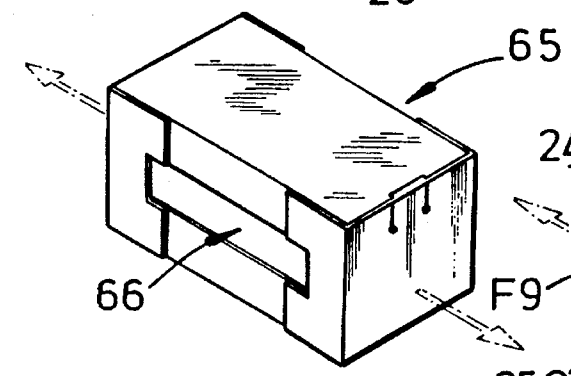
FIG. 8 is a perspective view of a closed hooded tray made from FIG. 3 blanks.

As a result, the erected hooded tray 65 (see FIG. 8) has side windows 66 through which contained products can be viewed and inspected.

Figure 4:
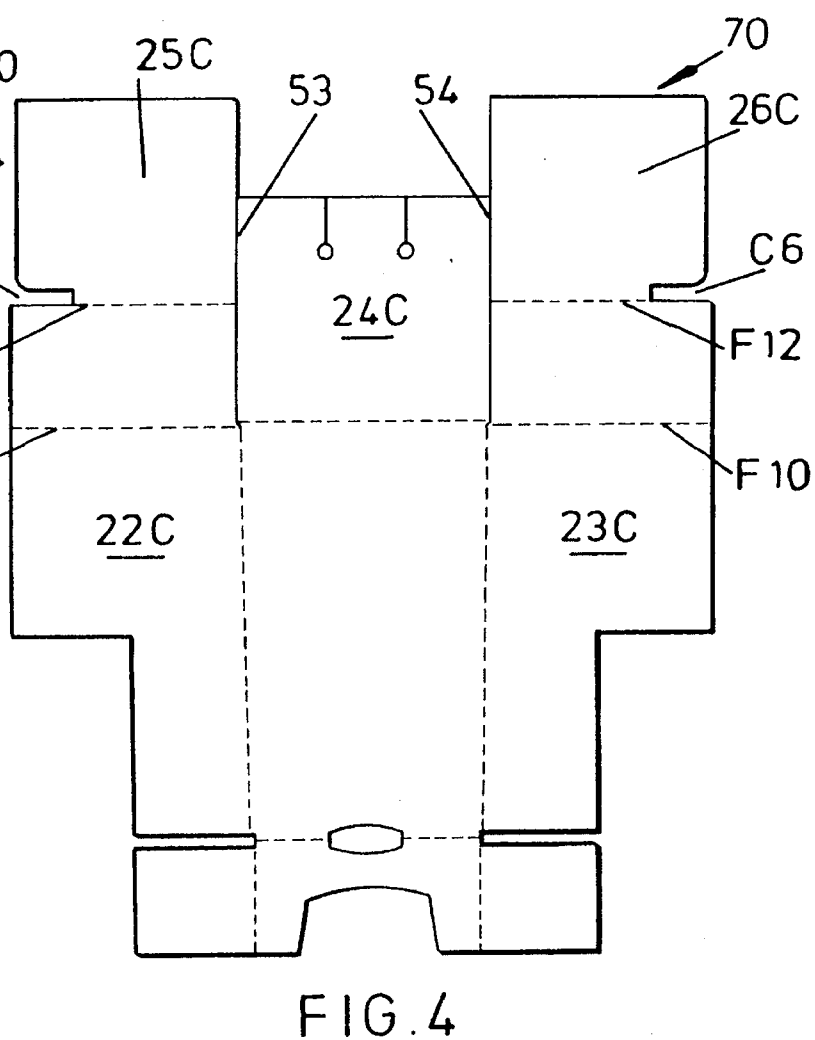

Referring now to the blank 70 of FIG. 4, the side wall panels 22C, 23C are of stepped shape, i.e. they are of dual width, as shown, and they are joined to side flaps 25C, 26C by fold lines.

The side flaps 25C, 26C are longer than the end wall panel 24C and are separated therefrom by slits or cuts 53, 54.

The side flaps 25C, 26C each have an intermediate fold line F11, F12 respectively parallel with fold lines F9 and F10 and joining the respective slit 53 or 54 and a cut-out C5 or C6 in the side edge of the respective side flap 25C, 26C.

Figure 9:
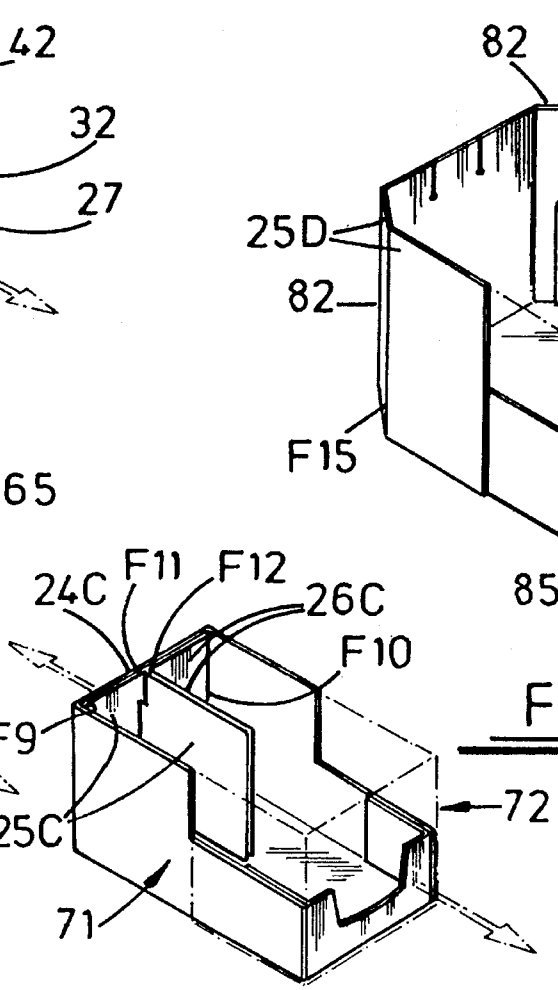
FIG. 9 is a perspective view of a tray erected from a FIG. 4 blank.

In erecting this blank 70 to form a tray 71 (see FIG. 9—a matching tray 72 is shown in ghost lines), the end wall panel 24C is disposed outside with the side flaps 25C, 26C respectively folded about fold lines F9, F11 and F10, F12 so that part of each side flap 25C, 26C lies against the end wall panel 24C with the other part extending inwardly at right angles to the latter to form a divider or partition. The latter is, of course, constituted by two thicknesses of board as shown.

In a hooded tray formed from such blanks the interior is consequently divided into two equal areas of product contaminant.

Also, the upstanding side walls defined by the stepped configuration are of a length that their vertical edges butt in the assembled hooded tray so providing increased stacking strength.

Finally, referring to the blank 80 (FIG. 5), this is designed to form a tray 81 (FIG. 10) having chamfered corners 82 as shown.

To this end, the corners of the main panel 21D are cut off at an angle as indicated at 83, and each side wall panel 22D, 23D has at each end a flap 84, 85 foldable about fold lines F13, F14.

Also, the side flaps 25D, 26D of end wall panel 24D extend laterally beyond the side wall panels 22D, 23D and are formed with intermediate lengthwise fold lines F15 and F16 respectively.

Further the combined width of the end wall panel 28D and its side flaps 29D, 30D is less than that of the main panel 21D and the side wall panels 22D and 23D.

Figure 10:
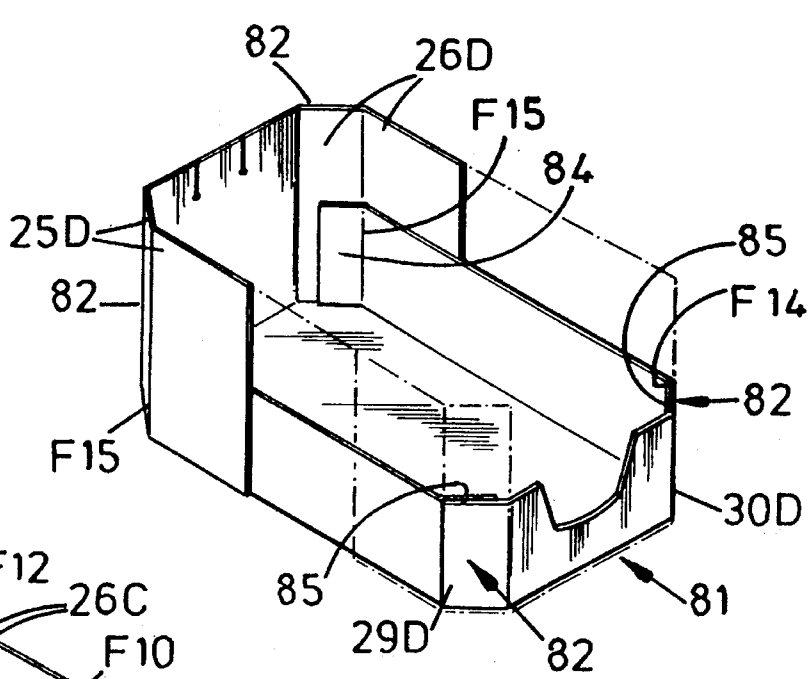
FIG. 10 is a perspective view of a tray erected from a FIG. 5 blank.

The intermediate fold lines F15, F16 and the angled corners of the main panel 21D allow erection of the blank to provide the tray 81 with the chamfered corners 82 as shown in FIG. 10 at one end, and at the other end the flaps 29D, 85 and 30D, 85 contact with the angled corners to provide the chamfered corners 82 at that end.

Figure 12:
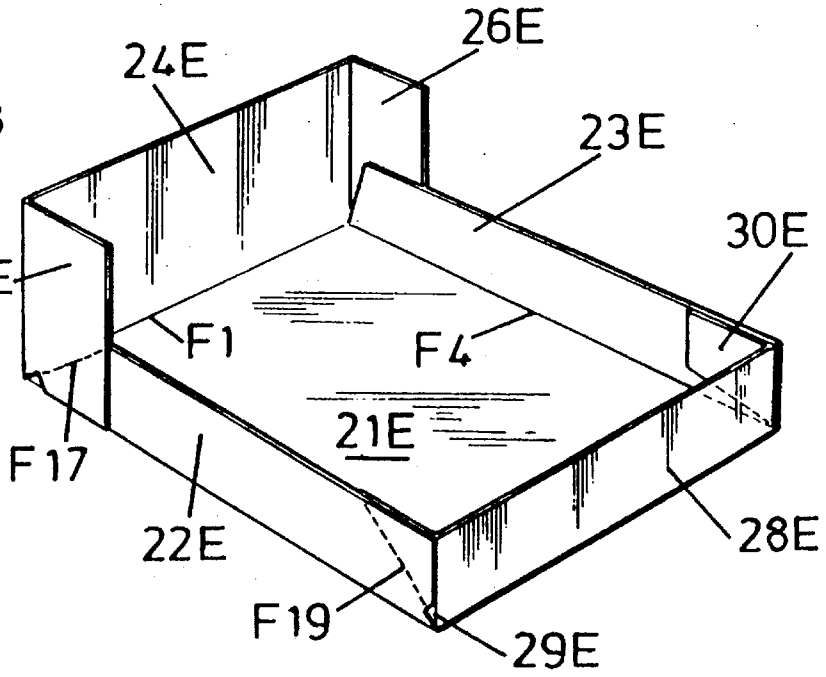
FIG. 12 is a perspective view of a tray erected from the blank of FIG. 11.
Figure 11:
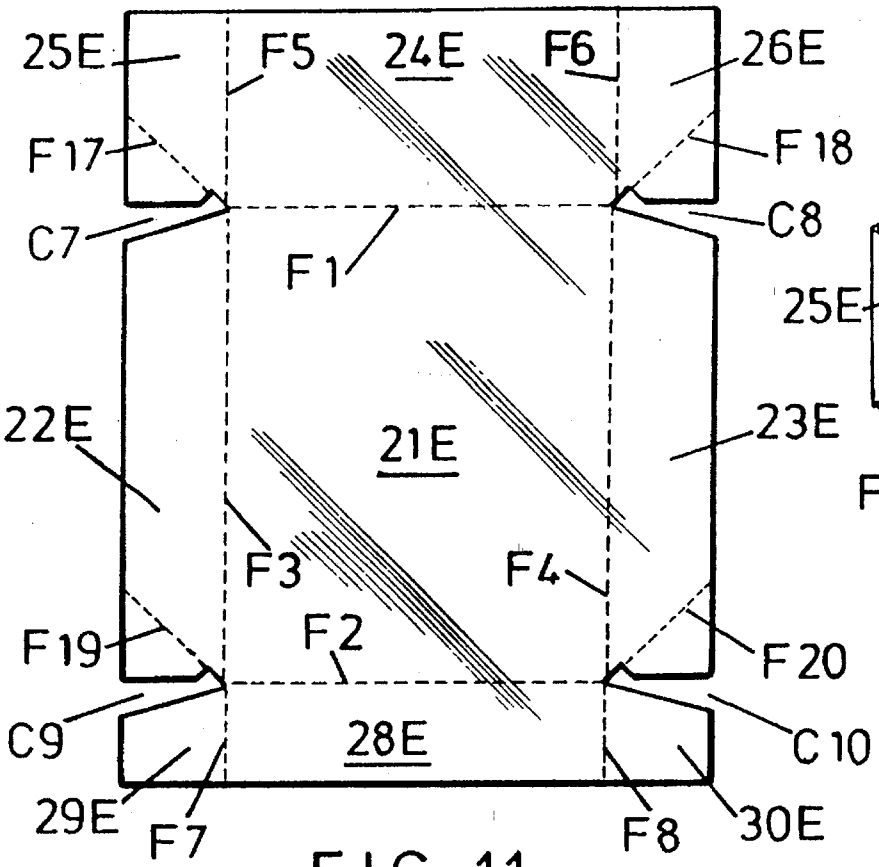
FIG. 11 is a plan view of a further blank for erecting to form a tray according to the present invention.

FIGS. 11 and 12 illustrate a further embodiment of the invention which can be supplied to the end views already glued but folded flat. FIG. 11 shows the blank from which the tray of FIG. 12 can be erected. The blank comprises a main panel 21E, side panels 22E and 23E, end wall panel 24E supporting side flaps 25E and 26E, and end wall panel 28E supporting side flaps 29E and 30E. Fold lines F1 to F8 are provided as in the embodiment of FIG. 1. Further fold lines F17 to F20 are also provided, the fold lines F17 and F19 being inclined at 45° to fold lines F5 and F3 respectively, and the fold lines F18 and F20 being inclined at 45° to fold lines F6 and F4 respectively. The fold lines F17 to F20 intersect the respective corners of the main panel. The main panel 21E is narrower than end panel 24E but wider than end panel 28E. For example, the distance between fold lines F5 and F6 may be 276 mm, the distance between fold lines F3 and F4 may be 272 mm, and the distance between fold lines F7 and F8 may be 268 mm.

Cut-outs C7 to C10 are provided, the lower boundary (in FIG. 1) of each cut-out being downwardly inclined relative to the main panel 21E. The upper boundary (in FIG. 11) of each cut-out defines an upwardly directed triangular notch adjacent the main panel 21E. The configuration of the cut-outs enables folding flat of the erected structure as described below.

When erected, the triangular areas defined between the fold lines F17 to F20 and the respective cut-outs C7 to C10 are glued to the adjacent side panels and side flaps as illustrated in FIG. 12. For example, side flap 25E is glued to the outer face of side wall panel 22E, the glue only being applied to the bottom left hand corner (in FIG. 11) of side flap 25E such that after gluing the fold line F17 defines a hinge about which the unglued portion of the side flap 25E can swing. Once glued, the erect tray can be folded flat by pushing side wall panels 22E and 23E down onto the main panel 21E, thereby pulling in the side flaps as folding takes place about fold lines F17 to F20. This causes the folding down of the end wall panels about fold lines F1 and F2. Thus, the glued tray can be delivered in a compact form to end users ready glued, and the end users do not need gluing facilities.

I claim:

1. A hooded tray comprising two open-top trays adapted for detachable open-top to open-top assembly into a closed transport configuration, wherein each tray has a main panel supporting first and second opposed end walls and first and second opposed side walls, the end and side walls of each tray are secured together by flaps at corners of the main panels, at least two of the flaps comprising opposing upstandable portions adjacent the first end wall, the dimensions of the main panels of the two trays are substantially equal, the widths of the first end walls of the two trays are substantially equal, the widths of the second end walls of the two trays are substantially equal, the height of each first end wall is greater than the height of each second end wall, the width of each first end wall is greater than the width of each second end wall, the width of the main panel adjacent the second end wall is less than the width of the first end wall, and the width of the main panel adjacent the first end wall is greater than the width of the second end wall, whereby when assembled the second end wall of each tray may be readily inserted between the upstandable portions of the other tray such that the second end wall of one tray abuts the first end wall of the other tray.

2. The hooded tray according to claim 1, wherein the height of at least one upstandable portion of each tray is substantially equal to the height of the adjacent first end wall.

3. The hooded tray according to claim 1 or claim 2, wherein the heights of each upstandable portion of the two trays are substantially equal to each other and to the height of the first end walls.

4. The hooded tray according to claim 1, wherein the two trays are identical.

5. The hooded tray according to claim 1, wherein the upstandable portions of each tray are formed by the flaps that secure the side walls of each respective tray to its first end wall.

6. The hooded tray according to claim 1, wherein the width of the main panel of each tray adjacent the respective first end wall is greater than the width of the main panel of each tray adjacent the respective second end wall, such that in plan view each tray tapers inwardly from its first end wall to its second end wall.

7. The hooded tray according to claim 1, wherein the upstandable portions of each tray extend half of the length of the respective tray.

8. The hooded tray according to claim 1, wherein the side walls of each tray are recessed or are cut out so that in the assembled hooded tray a window is formed in each side whereby the contained products can be readily viewed and/or inspected.

9. The hooded tray according to claim 1, wherein each end wall is secured to both side walls such that the side and end walls may be folded flat.

10. A hooded tray comprising two open-top trays adapted for detachable open-top to open-top assembly into a closed transport configuration, wherein each tray has a main panel supporting first and second opposed end walls and first and second opposed side walls, the end and side walls of each tray are secured together by flaps at corners of the main panels, at least two of the flaps comprising opposing upstandable portions adjacent the first end wall, the dimensions of the main panels of the two trays are substantially equal, the widths of the first end walls of the two trays are substantially equal, the widths of the second end walls of the two trays are substantially equal, the height of each first end wall is greater than the height of each second end wall, the width of each first end wall is greater than the width of each second end wall, the width of the main panel adjacent the second end wall is less than the width of the first end wall, and the width of the main panel adjacent the first end wall 24 is greater than the width of the second end wall, whereby when assembled the second end wall of each tray may be readily inserted between the upstandable portions of the side walls of the other tray such that the second end wall of one tray abuts the first end wall of the other tray, wherein each tray is provided with a dividing wall or partition parallel with its side walls and extending for half, or substantially half, of the length of the tray, the dividing walls or partitions in the assembled hooded tray abutting end-to-end to divide the interior thereof into two separate side-by-side areas.

11. A blank for erection to a tray adapted for assembly into a hooded tray, the blank comprising:

a main panel constituting the top or bottom of a hooded tray, two opposed side wall panels integral with the main panel at opposite sides thereof, an end wall panel integral with one end of the main panel and having opposed lateral securing flaps, an end wall panel integral with the other end of the main panel and having opposed lateral securing flaps, the length of the latter end wall panel and its securing flaps being greater than the length of the former end wall panel and its securing flaps, the width of the latter end wall panel being greater than the width of the former end wall panel, the width of the main panel adjacent the former end wall being less than the width of the latter end wall, and the width of the main panel adjacent the latter end wall being greater than the width of the former end wall.

12. The blank according to claim 11, wherein the sum of the widths of the main panel and the two side wall panels is the same as the sum of the widths of each end panel and its respective lateral securing flaps.

13. The blank according to claim 11, wherein the sum of the widths of the latter end wall panel and its securing flaps is greater than the sum of the widths of the main wall panel and the two side panels and is greater than the sum of the widths of the former end wall panel and its securing flaps.

14. The blank according to claim 13, wherein the sum of the widths of the main panel and the two side panels is equal to the sum of the widths of the former end panel and its securing flaps.

15. The blank according to claim 11, wherein the side wall panels and the securing flaps of the latter end wall panel are recessed to define window areas in the tray formed by the erected blank.

16. The blank according to claim 11, wherein the former end wall panel is recessed to provide a viewing or access area in the tray formed by the assembled blank.

17. The blank according to claim 11, wherein the main panel has chamfered corners with the side wall panels having end securing flaps and the securing flaps of the latter end wall panel being foldable to provide for chamfered corners in the tray formed by the erected blank.

18. The blank according to claim 11, wherein the main panel is wider than the former end wall panel and narrower than the latter end wall panel.

19. The blank according to claim 18, wherein the lateral securing flaps of the latter end wall panel are foldable about fold lines arranged to intersect the adjacent corners of the main panel such that the lateral securing flaps may be folded double between the main panel and the latter end wall panel, and the side wall panels are foldable about fold lines arranged to intersect respective corners of the main panel adjacent the former end wall panel, cut cuts-being provided to enable the folding flat of the blank after securing the side wall panels to the lateral securing flaps.

20. The blank according to claim 11, wherein the main panel is tapered inwardly from its end adjacent the latter end wall panel to its end adjacent the former end wall panel.

21. A blank for erection to a tray adapted for assembly into a hooded tray, the blank comprising a main panel constituting the top or bottom of a hooded tray, two opposed side wall panels integral with the main panel at opposite sides thereof, an end wall panel integral with one end of the main panel and having opposed lateral securing flaps, an end wall panel integral with the other end of the main panel and having opposed lateral securing flaps, the length of the latter end wall panel and its securing flaps being greater than the length of the former end wall panel and its securing flaps, the width of the latter end wall panel being greater than the width of the former end wall panel, the width of the main panel adjacent the former end wall being less than the width of the latter end wall, and the width of the main panel adjacent the latter end wall being greater than the width of the former end wall, wherein the side wall panels, for a first part of their lengths, are of greater width than for a second part, the sum of the widths of the first parts of the side wall panels and the main panel is equal to the sum of the widths of the latter end wall panel and its securing flaps, and the latter end wall panel has integral therewith partition flaps adapted, in the assembled blank to be contiguous, lie inboard of the latter end wall panel, and be parallel with the side wall panels.

* * * * *

UNITED STATES PATENT AND TRADEMARK OFFICE

CERTIFICATE OF CORRECTION

PATENT NO. : 5,590,788

DATED : January 7, 1997

INVENTOR(S) : Michael Inman

It is certified that error appears in the above-identified patent and that said Letters Patent is hereby corrected as shown below:

On the title page, Item [73], change "Assi Packaging Systems Unlimited" to --Assi Packaging Systems Limited--.

Signed and Sealed this

Nineteenth Day of August, 1997

Bruce Lehman

*Attest:*

BRUCE LEHMAN

*Attesting Officer*

*Commissioner of Patents and Trademarks*